US006096162A

United States Patent [19]

Lin et al.

[11] Patent Number: 6,096,162

[45] Date of Patent: Aug. 1, 2000

[54] CHEMICAL MECHANICAL POLISHING MACHINE

[75] Inventors: Juen-Kuen Lin, Kaohsiung; Chien-Hsin Lai, Kaohsiung Hsien; Peng-Yih Peng, Hsinchu Hsien; Chia-Jui Chang, Chilung, all of Taiwan

[73] Assignee: United Microelectronics Corp., Hsinchu, Taiwan

[21] Appl. No.: 09/205,561

[22] Filed: Dec. 4, 1998

[51] Int. Cl.[7] ..... C23F 1/02

[52] U.S. Cl. ..... 156/345; 451/287; 451/288; 438/693

[58] Field of Search ..... 156/345; 451/287, 451/288; 216/88, 89; 438/692, 693

[56] References Cited

U.S. PATENT DOCUMENTS 5,658,185 8/1997 Morgan, III et al. ..... 451/288 X 5,922,620 7/1999 Shimomura et al. ..... 156/345 X

*Primary Examiner*—Thi Dang

*Attorney, Agent, or Firm*—Hickman Stephens Coleman & Hughes, LLP

[57] ABSTRACT

A CMP machine includes several polishing tables mounted on a carousel, which rotates in one direction. Each of the polishing tables includes a polishing pad. Each polishing pad can polish one wafer on its first surface. Each polishing pad also has one distributing duct used to supply slurry onto the polishing pad. An exhaust duct is included to exhaust slurry, in which the exhaust duct has a first end and a second end. The first end of the exhaust duct is coupled to slurry. A regulating valve is included to regulate slurry exhaust. An exhaust pump is included to produce a exhausting force of slurry. The exhaust pump is coupled to the second end of the exhaust duct. A regulating valve controller is included to control the regulating valve.

9 Claims, 3 Drawing Sheets

CHEMICAL MECHANICAL POLISHING MACHINE

BACKGROUND OF THE INVENTION

1. Field of the Invention

This invention relates to semiconductor fabrication equipment, and more particularly to a chemical mechanical polishing machine, which has a capability to control a slurry exhaust status.

2. Description of Related Art

As integration of a semiconductor device increases, in accordance with the needs of interconnects in a reduced dimension of a metal-oxide semiconductor (MOS) transistor, it is necessary to design a circuit with at least two levels of interconnect metal layers. The multilevel interconnect structure usually include several inter-layer dielectric (ILD) layers and several inter-metal dielectric (IMD) layers for a purpose of isolation between the interconnect metal layers. When design rules become finer, the quality of the ILD layers or the IMD layers is necessary to be higher. For example, a higher quality of planarization on the ILD layers or the IMD layers is desired.

In order to allow the multilevel interconnect structure to be more easily formed and a pattern to be more precisely transferred, it is essential to have a good planarization quality on a wafer surface which has uneven surface due to some device structure being formed underneath. Moreover, planarization quality also affect the precision of an alignment system. If the wafer is not properly planarized, not only a photo-mask cannot be precisely aligned but also a probability of fabrication error can increase.

In semiconductor fabrication, planarization technologies are essential to allow a high-density photolithography process can be performed because a planar surface can avoid a light scattering phenomenon during the photolithography process. The pattern transfer therefore can be precisely obtained. Currently, the planarization technologies includes two most common process. One is spin-on glass (SOG) technology, and the other one is chemical mechanical polishing (CMP) technology. The SOG technology can planarize a local region with very high quality, and the CMP technology can globally planarize the wafer with an acceptable quality even though the planarization quality is not as good as the quality of the SOG technology. However, when the semiconductor fabrication achieves a sub-half-micron fabrication level, the SOG technology becomes insufficient to the need of planarization due to a globally high pattern density. The CMP technology becomes the only one having capability to globally planarize the wafer in very-large scale integration (VLSI) fabrication or even in ultra-large scale integration (ULSI) fabrication.

A CMP process makes use of a polishing object like a polishing knife with a reagent to polish the uneven surface contour so as to planarize the surface. In the CMP process, the reagent is usually referred to as a slurry. Slurry usually includes a solution mixed with silica in colloidal phase or materials in dispersed phase such as aluminum, KOH or $NH_4OH$. The grinding particles are extremely hard and have a diameter of about 0.1–0.2 $\mu$m. Basically, these particles are used to polish the wafer surface. A wafer is held by holder on it backside. The front side is properly pressed onto a polishing pad which is held by a polishing table. Both the wafer and the polishing pad are rotating with a controlled speed. So the wafer surface is polished and planarized.

In order to prevent the wafer surface from being scratched due to impure particles in slurry, before slurry is transported to the polishing pad, slurry is necessary to be filtered by a filter.

FIG. 1 is a top view of a conventional CMP machine. In FIG. 1, inside a platen 10, there are a housing 20, a carousel 30 on the housing 20, and several polishing heads 40*a* 40*b*, 40*c*, 40*d*, 40*e*, and 40*ef* evenly distributed on the rim of the carousel 30. The carousel 30 rotates in one direction. Moreover, an exhaust duct 50 is connected to the housing 20 on one end. The other end of the exhaust duct 50 has a damper valve 60, and an exhaust pump 70. The exhaust pump 70 provides a driving force to exhaust slurry.

However, the damper valve 60 in the conventional CMP machine is controlled by hand. This is very inconvenient to control a slurry exhaustion. Moreover, when polishing process temporarily stop, slurry is not supplied. If the damper valve 60 is not closed in time, the exhaust pump 70 can continuously exhaust slurry and causes the polishing heads 40*e* and 40*f*, which are close to one end of the exhaust duct 50, to be over-dried. This over-dried polishing heads 40*e* and 40*f* have a poor polishing capability when the polishing process starts again so that the planarity of the CMP process is deteriorated.

SUMMARY OF THE INVENTION

It is therefore an objective of the present invention to provide a CMP machine with a capability to control the slurry exhausting status so that slurry is avoided to be over-dried due to a continuous slurry exhaust when slurry is not supplied at a temporary stop stage of the CMP process. The quality of the CMP process is therefore maintained.

In accordance with the foregoing and other objectives of the present invention, a CMP machine with a capability to control the slurry exhausting status is provided. The CMP machine of the invention includes several polishing tables mounted on a carousel, which rotates in one direction. Each of the polishing tables includes a polishing pad. Each polishing pad can polish one wafer on its first surface. Each polishing pad also has one distributing duct used to supply slurry onto the polishing pad. An exhaust duct is included to exhaust slurry in which the exhaust duct has a first end and a second end. The first end of the exhaust duct is coupled to slurry. A regulating valve is included to regulate slurry exhaust. An exhaust pump is included to produce a exhausting force of slurry. The exhaust pump is coupled to the second end of the exhaust duct. A regulating valve controller is included to control the regulating valve. So, the CMP machine of the invention is accomplished.

BRIEF DESCRIPTION OF DRAWINGS

The invention can be more fully understood by reading the following detailed description of the preferred embodiment, with reference made to the accompanying drawings as follows.

DETAILED DESCRIPTION OF THE EMBODIMENT

Figure 2A:
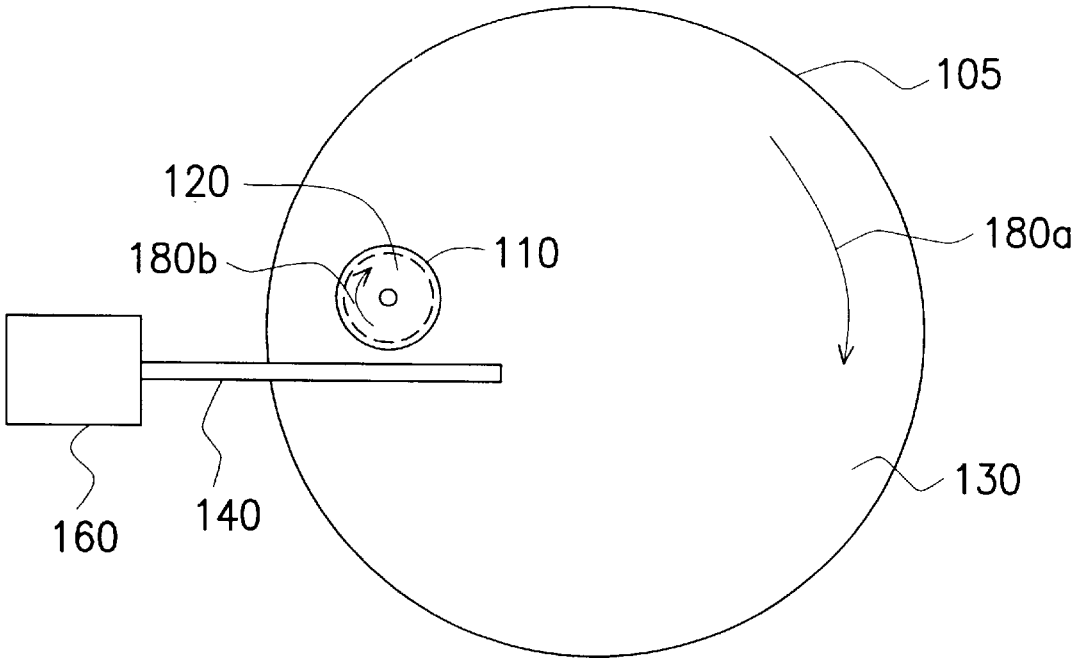
FIG. 2A is a schematic drawing illustrating a top view of a polishing table of a CMP machine, according to a preferred embodiment of the invention.
Figure 2B:
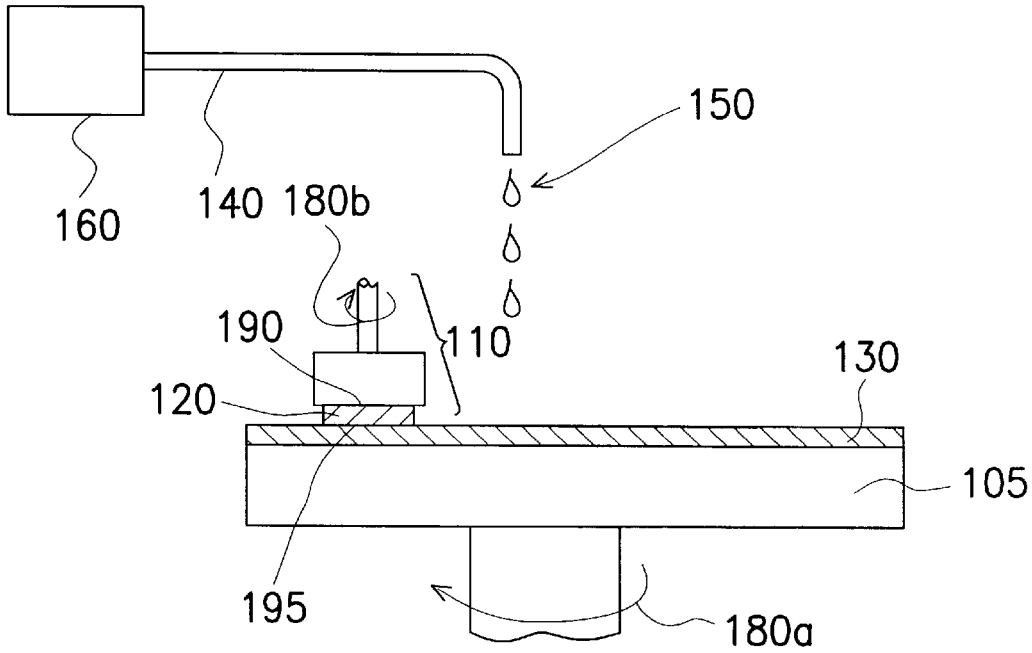
FIG. 2B is a schematic drawing illustrating a side view of a polishing table of a CMP machine, according to a preferred embodiment of the invention.

A chemical mechanical polishing (CMP) machine of the invention using a regulating valve controller to control a regulating valve so that slurry is not over-dried. The CMP machine includes several polishing tables. Each of the polishing tables can polish one wafer. One of the polishing tables is described following:

FIG. 2A is a schematic drawing illustrating a top view of a polishing table of a CMP machine, according, to a preferred embodiment of the invention. FIG. 2B is a schematic drawing illustrating a side view of a polishing table of a CMP machine, according to a preferred embodiment of the invention. In FIG. 2A and FIG. 2B, a polishing table 105 includes a holder 110 to hold a wafer 120. A polishing pad 130 is held by the polishing table 105. A tube 140 is used to transport slurry 150 to the polishing pad 130. A supplying pump 160 is globally used to produce the transporting force to transport the slurry 150 through the tube 140. The number of the supply pump 160 is preferably one in the whole CMP machine. It is not necessary to have one supplying pump 160 for each polishing table 105. When the polishing process is performed the polishing table 105 and the holder 110 rotate along their individual directions 180*a*, 180*b*. The holder 110 holds the wafer 120 from its backside 190. A front side 195 of the wafer 120 is pressed onto the polishing pad 130 as to polish the front side 195, on which are there many device structures formed. The supplying pump 160 continuously transport the slurry 150 through the tube 140 onto the polishing pad 150 near the wafer 120. The front side 195 can react with the slurry 150 so as to ease the surface to be more easily polished. The slurry contains abrasive grinding particles allow the surface to be mechanically polished. This is the CMP process, which includes mechanical and chemical mechanisms. The CMP process is therefore a planarization process, because it can polish away the convex part on the front side 195 of the wafer 120 so as to get a planar surface.

Figure 1:
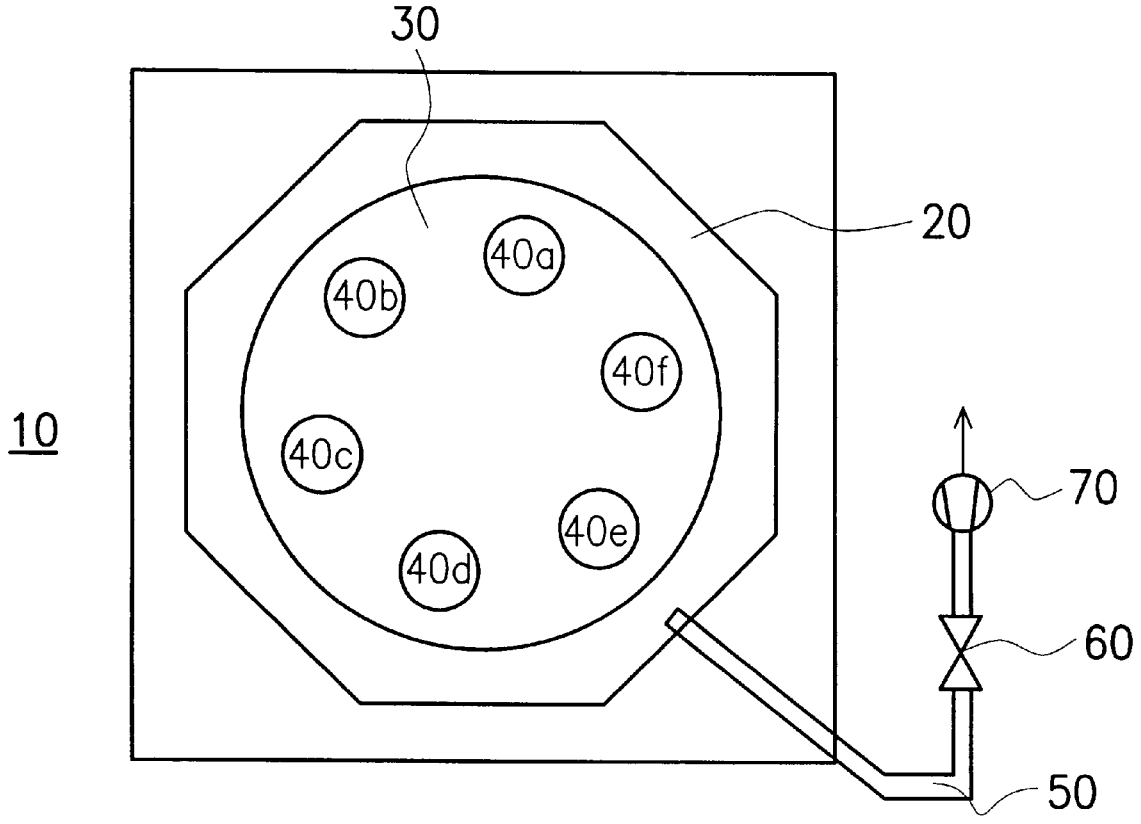
FIG. 1 (PRIOR ART)
FIG. 1 is a schematic drawing illustrating a top view of a conventional CMP machine.
Figure 3:
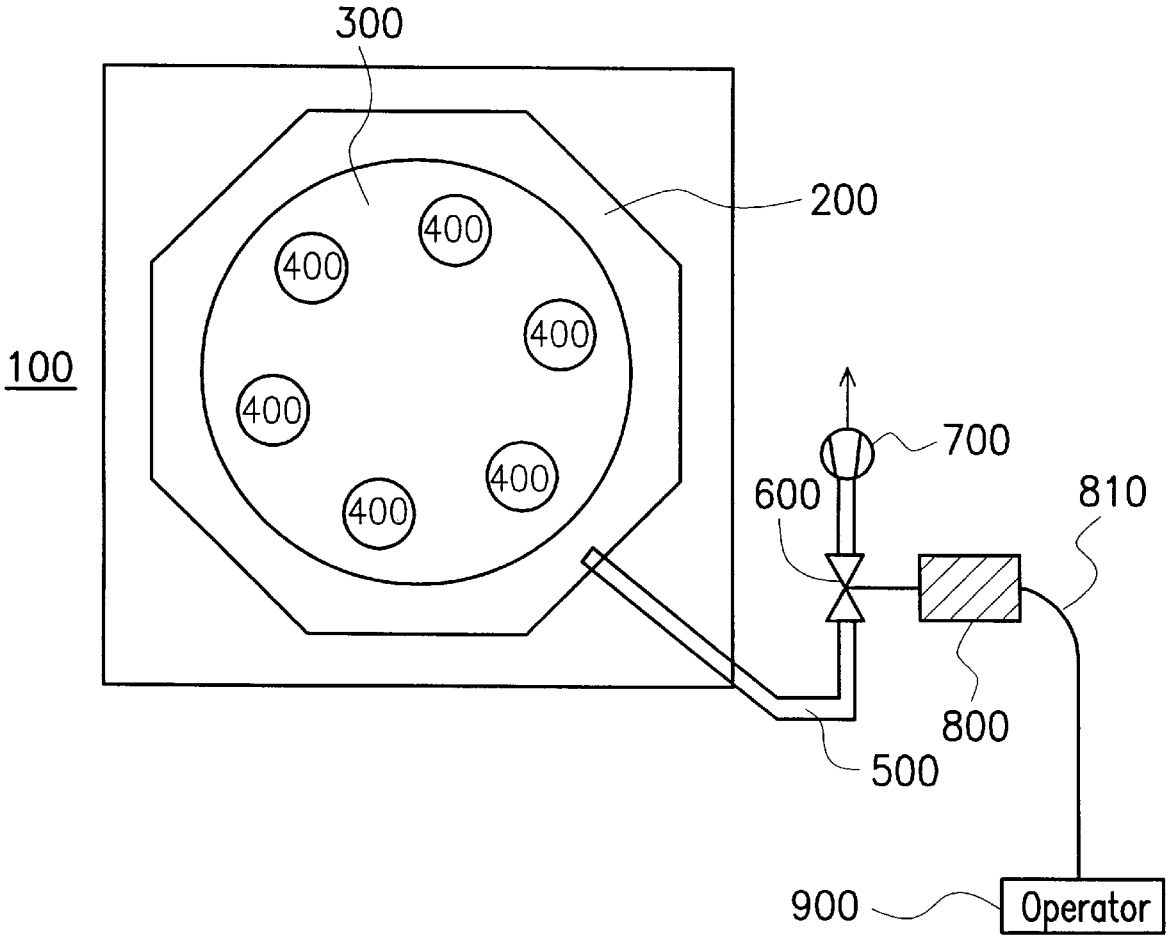
FIG. 3 is a schema tic drawing illustrating a top view of a CMP machine, according to a preferred embodiment of the invention.

FIG. 3, is a schematic drawing illustrating a top view of a CMP machine, according to a preferred embodiment of the invention. In FIG. 3, inside a platen 100, there are a housing 200, a carousel 300 on the housing 20, and several polishing tables 400, such as six, evenly distributed on the rim of the carousel 300. The polishing tables 400 are describe in FIG. 2A and FIG. 2B. The carousel 300 rotates in one direction. Moreover, an exhaust duct 500 is connected to the housing 200 on one end. The other end of the exhaust duct 500 has a damper valve 600, and an exhaust pump 70. The exhaust pump 700 provides a exhausting force to exhaust slurry. Furthermore, a controller 800 is included and is coupled to the damper valve 600 so as to control the on/off of the damper valve 600 in time. When the slurry 150 of FIG. 2B is not supplied due to a temporary stop of operation, the controller 800 closes the damper valve 600 in time. The exhaust pump 700 does not locally over-dry slurry near to the end of the exhaust duct 500. As described in FIG. 1, if the polishing tables 400 near to the of the exhaust duct 500, they may have a poor efficiency of polishing due to over-dried slurry.

A control signal line 810 is used for a coupling between the controller 800 and an operator 900. The control signal line 810 can be any means, which can allow the operator 900 to send a signal to the controller. The controller 800 can even serve as a vale by itself. When the slurry 150 is not supplied, the operator can send a control signal to the controller 800 to close the damper valve 600. When the slurry start to supply the operator send a control signal to the controller 800 to open the damper valve 600. It is the characteristic that the invention controls the damper valve 600 remotely. In the conventional process, the damper valve 60 of FIG. 1 has to be closed by hand. Since the damper-valve 800 can be remotely controlled, the over-dried phenomenon is effectively avoided. The polishing quality is maintained. The wafer has a stable uniformity. The yield rate is thereby increased.

In conclusion, several characteristics of the invention are following:

1. The damper valve 600 can be remotely controlled preferably through the controller 800 and the signal control line 810 so that the slurry exhausting status is properly controlled in time. The polishing, quality is maintained. The wafer has a stable uniformity. The yield rate is thereby increased.

2. The invention controls the damper valve 600 through the controller 800. When the CMP process is performing the operator can remotely open the damper valve 600 in time. When the CMP process is stopped, the operator can remotely close the damper valve 600 in time without do it by hand.

The invention has been described using an exemplary preferred embodiment. However it is to be understood that the scope of the invention is not limited to the disclosed embodiment. On the contrary, it is intended to cover various modifications and similar arrangements. The scope of the claims, therefore, should be accorded the broadest interpretation so as to encompass all such modifications and similar arrangements.

What is claimed is:

1. A chemical mechanical polishing (CMP) machine comprising:

a carousel located in a housing, which is located on a platen;

at least one polishing table mounted on the carousel;

a polishing pad mounted on the polishing table;

a holder on the polishing table to hold a wafer from its backside so as to press a front surface of the wafer onto the polishing pad;

a tube on the polishing table to distribute a slurry onto the polishing pad near the wafer;

an exhaust duct having a first end and a second end, in which the first end is coupled to the housing in order to allow the slurry to be properly exhausted; and an exhaust control unit on the exhaust duct between the first end and the second end, in which the exhaust control unit is remotely controlled to determine whether the slurry is exhausted or not.

wherein when a CMP process is performed, the carousel, the polishing pad, and the holder are properly rotating in their own individual directions.

2. The CMP machine of claim 1, wherein the exhaust control unit further comprises a damper valve, in which is remotely controlled by an operator.

3. The CMP machine of claim 2, wherein the damper valve is remotely controlled by the operator through a controller to open or close the damper valve, and a signal line used by the operator to send a control signal to the controller.

4. The CMP machine of claim 1 wherein the exhaust duct further comprises an exhaust pump on the second end after the exhaust control unit so as to exhaust the slurry.

5. The CMP machine of claim 1, wherein the CMP machine further comprises a supplying pump to supply the slurry to the polishing pad through the tube on the polishing table.

6. A chemical mechanical polishing (CMP) machine comprising:

a carousel located in a housing, which is located on a platen;

a plurality of polishing tables mounted on the carousel;

each of the polishing tables comprising a polishing pad;

each of the polishing tables comprising a holder to hold a wafer from its backside so as to allow a front surface of the wafer to be pressed onto the polishing pad for polishing;

each of the polishing tables comprising a tube to allow a slurry to be distributed onto the polishing pad near the wafer;

an exhaust duct having a first end and a second end, in which the first end is coupled to the housing in order to allow the slurry to be properly exhausted at the second end; and an exhaust control unit on the second end of the exhaust duct, which is remotely controlled to determine whether the slurry is exhausted or not.

7. The CMP machine of claim 6, wherein the exhaust control unit further comprises a damper valve, which is remotely controlled by an operator through a controller to mechanically open or close the damper valve, and a signal line used by the operator to send a control signal to the controller.

8. The CMP machine of claim 6, wherein the exhaust duct further comprises an exhaust pump on the second end after the exhaust control unit so as to exhaust the slurry.

9. The CMP machine of claim 6, wherein the CMP machine further comprises a supplying pump to supply the slurry to the polishing pad through the tube on the polishing table.

* * * * *